US006929696B2

(12) United States Patent
Arvin et al.

(10) Patent No.: US 6,929,696 B2
(45) Date of Patent: Aug. 16, 2005

(54) APPARATUS AND SYSTEM FOR SPRAY COATING AN ARTICLE

(75) Inventors: James F. Arvin, Jasper, IN (US); Benjamin W. Hasenour, St. Anthony, IN (US)

(73) Assignee: Dubois Equipment Company, Inc., Jasper, IN (US)

( * ) Notice: Subject to any disclaimer, the term of this patent is extended or adjusted under 35 U.S.C. 154(b) by 79 days.

(21) Appl. No.: 10/375,740

(22) Filed: Feb. 26, 2003

(65) Prior Publication Data

US 2004/0163588 A1 Aug. 26, 2004

(51) Int. Cl.[7] ..... B05B 15/12
(52) U.S. Cl. ..... 118/326; 118/DIG. 7; 118/300
(58) Field of Search ..... 118/302, 61, 62, 118/63, 313, 314, 323, 324, 309, 326, 300, DIG. 7; 239/139, 424; 55/DIG. 46; 454/50

(56) References Cited

U.S. PATENT DOCUMENTS 4,499,911 A * 2/1985 Johnson ..... 131/302
5,387,444 A * 2/1995 Bachmann ..... 427/600
6,544,336 B1 * 4/2003 Lopes ..... 118/302
6,746,535 B2 * 6/2004 Hasenour et al. ..... 118/313

* cited by examiner

*Primary Examiner*—Chris Fiorilla
*Assistant Examiner*—Yewebdar Tadesse
(74) *Attorney, Agent, or Firm*—John R. Hoffman

(57) ABSTRACT

An apparatus is provided for spray coating an article and includes a housing defining a spray chamber. A spray gun is mounted on the housing for spray coating the article in the spray chamber. A shroud is disposed about the spray gun and defines an air passage between an inside of the shroud and an outside of the spray gun. Heated air is passed through the passage to heat the spray gun and, thereby, heat a coating material passing through the spray gun. A system includes a curing apparatus whereat the article, with the spray coating thereon, is finished by curing the spray coating. The curing apparatus creates an amount of heated air which is fed to the shroud.

5 Claims, 6 Drawing Sheets

APPARATUS AND SYSTEM FOR SPRAY COATING AN ARTICLE

FIELD OF THE INVENTION

The invention generally relates to an apparatus for coating articles or parts and, particularly, to an apparatus for spray coating with a coating material or composition which must be heated.

BACKGROUND OF THE INVENTION

Generally, it is known to spray paint or coat articles by an apparatus which uses one or more spray guns mounted on a housing which defines a spray chamber. The spray guns include nozzles which extend into the chamber for spraying a coating composition onto the articles. In some applications, it is desirable or necessary to heat the coating composition before it reaches the spray guns in order to effect proper spraying through the nozzles. Typically, the coating composition is heated at a location removed from the coating apparatus or, at least, the housing of the apparatus.

An example of an application where the coating composition must be heated is when using ultraviolet (UV) curable coating compositions. A 100% solids UV curable composition is a liquid composition and is void of solvents or dilutents which must be driven off in a curing or drying process. A UV composition cures only when exposed to ultraviolet light. A UV curable coating composition or material must be heated by the time the material reaches the spray gun of the coating apparatus.

Problems are encountered in using coating compositions which must be heated for spray coating purposes. Typically, the coating composition or material is heated at the source or supply thereof, i.e., before it teaches the spray guns at the coating apparatus. During transit, even with small distances, the coating material has a tendency to cool down before it reaches the spray guns. Another problem is maintaining consistency of the sprayed material. This is particularly a problem with "atomization" type spraying nozzles whether using UV compositions or other atomizing spray material. Different temperatures can cause different atomization characteristics, and the different temperatures can be caused simply by changes in the temperature of the environment surrounding the coating apparatus, much less differences in temperatures caused during transit of the coating material to the spray guns.

Still another problem with spray coating apparatus as described above, even divorced from the stated temperature problems, is the problem of dripping caused by the spray material forming droplets at or near the end of the nozzles of the spray guns. If a droplet of spray material falls on the article to be sprayed, a blemish is created. The present invention not only is directed to solving the problems associated with inconsistent temperatures at a spray gun, but the solution to those problems also functions to eliminate material dripping from the nozzles of the spray guns.

SUMMARY OF THE INVENTION

An object, therefore, of the invention is to provide a new and improved spray coating apparatus of the character described.

In the exemplary embodiment of the invention, a housing defines a spray chamber. A spray gun is mounted at the housing for spray coating an article in the spray chamber. A shroud is disposed about at least a portion of the spray gun and defines an air passage between an inside of the shroud and an outside of the spray gun. Means are provided for passing heated air through the passage to heat the spray gun and, thereby, heat a coating material passing through the spray gun.

As disclosed herein, the spray gun is elongated and the shroud is provided by a tubular member disposed about and substantially surrounding the spray gun. The tubular member is secured to the spray gun by a plurality of set screws in the tubular member and spaced longitudinally and circumferentially thereabout.

According to one aspect of the invention, the spray gun includes a nozzle from which the coating material is sprayed. The shroud includes an outlet opening near the nozzle to direct air across the nozzle and prevent coating material from forming droplets on the nozzle.

According to another aspect of the invention, the housing includes at least one downwardly sloping top wall having an opening through which the spray gun extends. The opening is generally teardrop-shaped to define a relatively narrow upper edge and a relatively wide lower edge to prevent droplets from forming along the edges of the opening. Substantially the entire peripheral edge of the opening is rounded and void of any sharp corners at which droplets would form.

According to a further aspect of the invention, a system is provided for spray coating and finishing an article, including the spray coating apparatus described above. In addition, a curing apparatus is provided, whereat the article, with a spray coating thereon, is finished by curing the spray coating, with the curing apparatus creating an amount of heated air. Conduit means directs the heated air from the curing apparatus to the shrouds about the spray guns of the spray coating apparatus.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
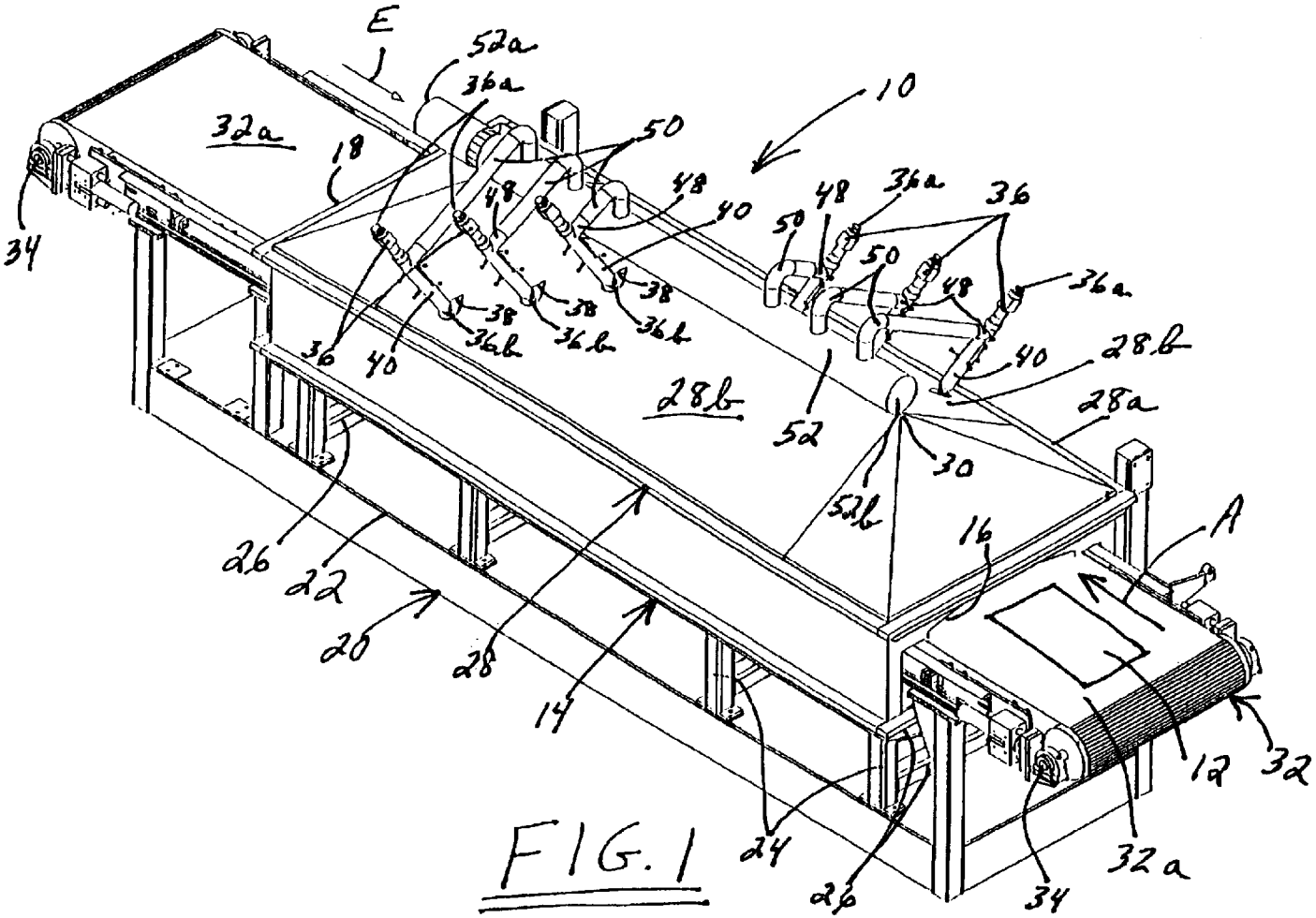
FIG. 1 is a top perspective view of a coating apparatus incorporating the concepts of the invention.
Figure 2:
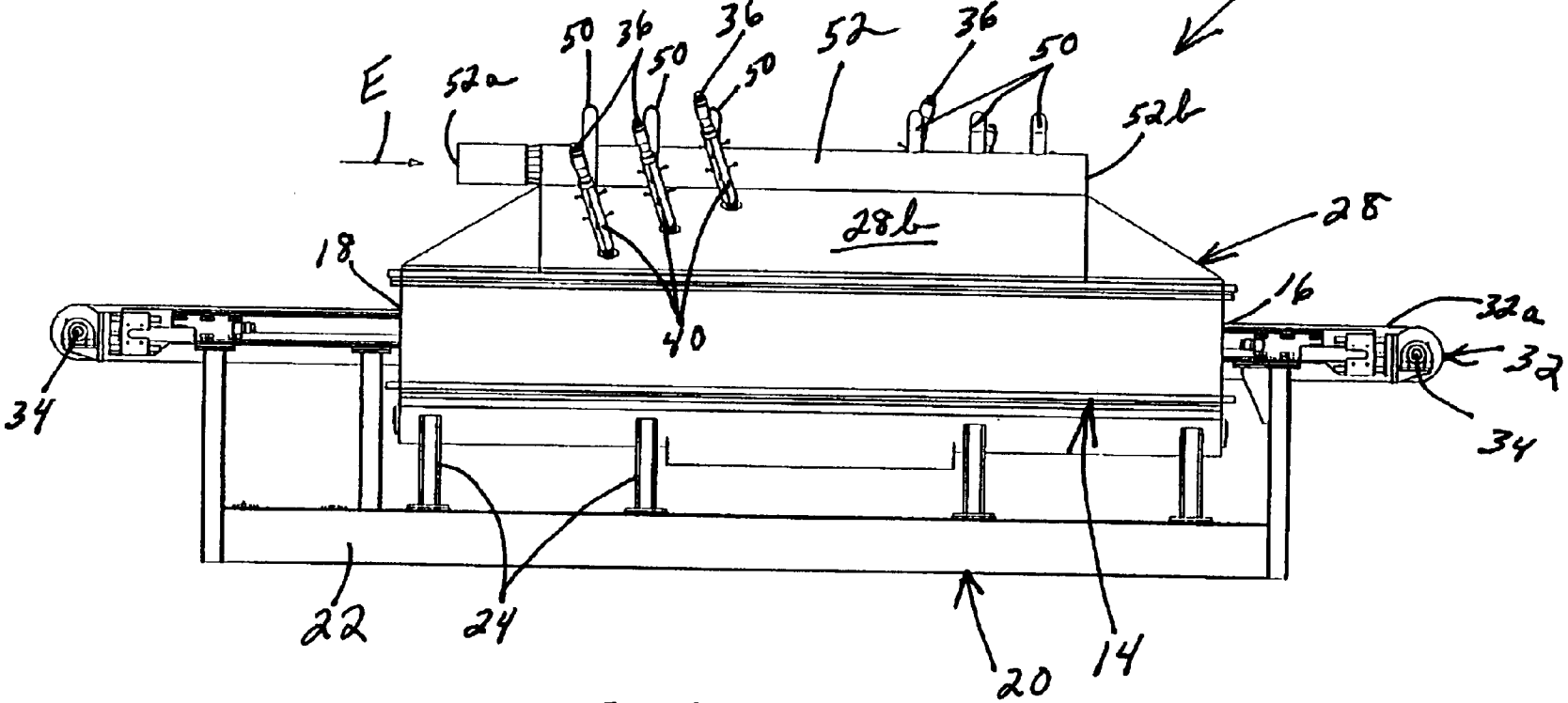
FIG. 2 is a side elevational view of the apparatus.
Figure 3:
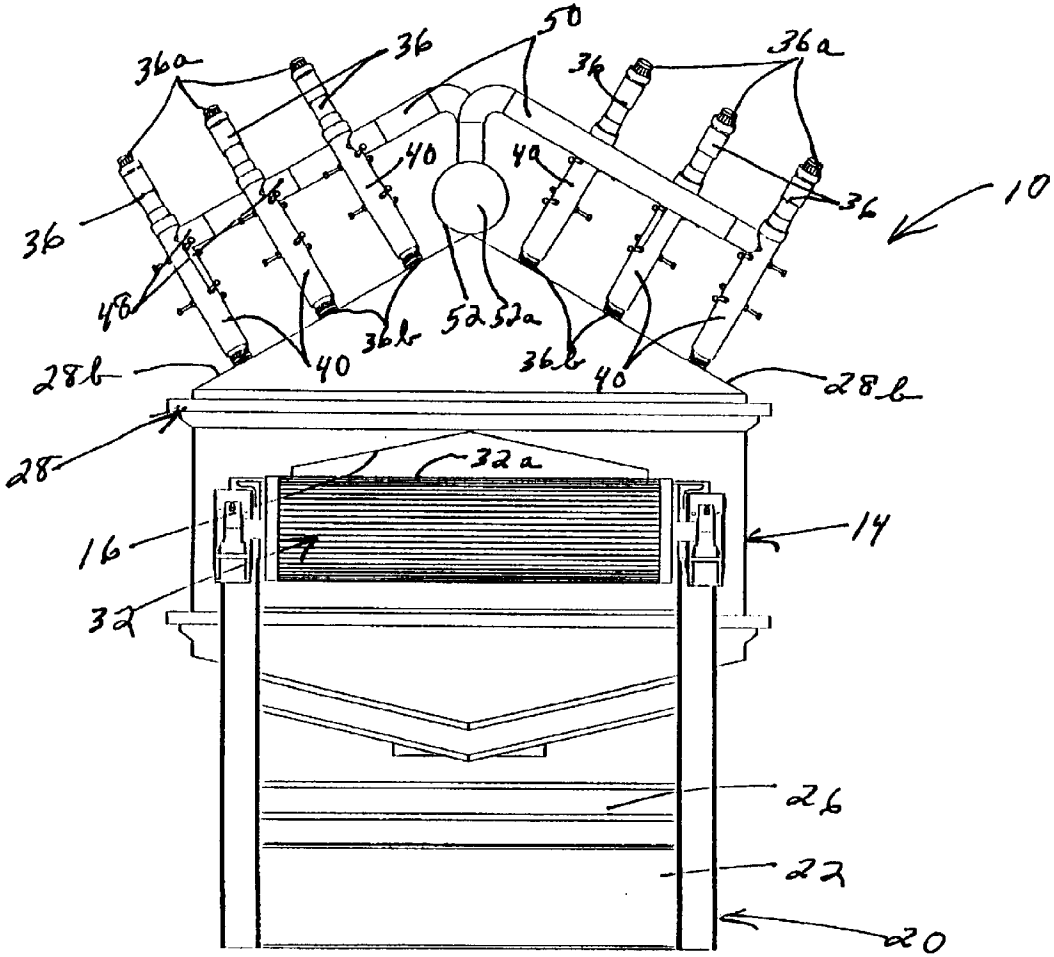
FIG. 3 is an end elevational view of the apparatus looking at the right-hand end of FIG. 2.

Referring to the drawings in greater detail, and first to FIGS. 1–3, the invention is embodied in an apparatus, generally designated 10, for coating continuously advancing articles 12 (FIG. 1) which are advanced through the apparatus in the direction of arrow "A". The apparatus includes a housing, generally designated 14, which defines a spray chamber there-within and which includes an inlet end 16 and an outlet end 18. The housing is substantially fabricated of stainless steel sheet metal material. The housing is mounted on top of a supporting framework, generally designated 20. The supporting framework includes a floor platform 22, a plurality of support posts 25 projecting upwardly from the floor platform and a plurality of cross braces 26.

The housing includes a cover, generally designated 28, which may be pivotally mounted along a rear edge 28*a* by appropriate pivot means (not shown) in order to allow the cover to be raised to gain access to the spray chamber within the housing. The cover has angled top walls 28*b* which join at an apex 30 defining a center-line which extends in a direction between inlet end 16 and outlet end 18 of the housing. The top walls are at an angle of approximately 25°–30° to allow spray composition to flow down the interior of the walls.

A conveying means, generally designated 32, transports articles 12 through the spray chamber defined by housing 14 from the inlet to the outlet ends 16 and 18, respectively. The conveying means is provided herein by an endless conveyor belt having an upper run or surface 32*a* which, in essence, forms the bottom of the spray chamber within housing 14. An electric motor (not shown) operates the conveyor belt by rotating one or the other of a pair of shafts 34 at opposite ends of the conveyor belt.

A plurality of spray guns 36 are mounted above cover 28. Each spray gun includes an inlet end 36*a* which is connected by appropriate conduit means (not shown) to a source of a spray composition. The spray guns are elongated and have nozzles 36*b* at ends of the guns opposite inlet ends 36*a*. The nozzles project through openings 38 in angled top walls 28*b* of cover 28.

Figure 4:
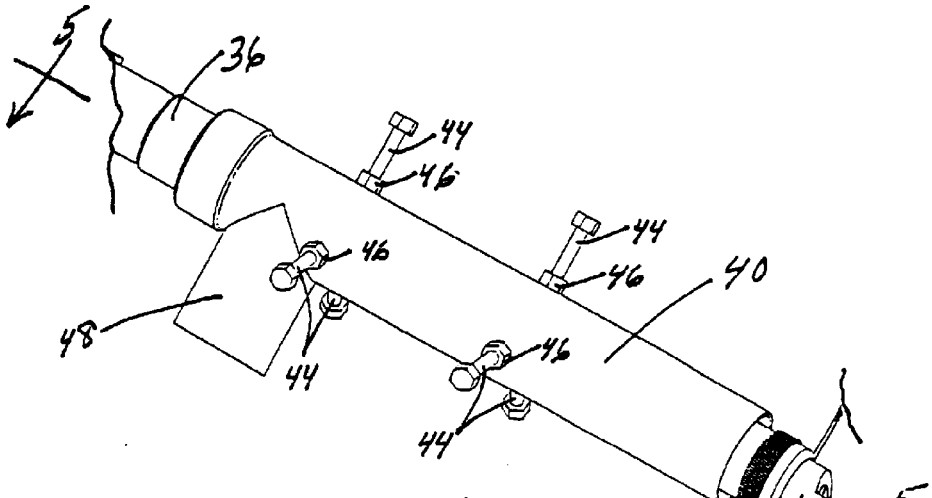
FIG. 4 is an enlarged, side elevational view of one of the spray guns and its surrounding shroud according to the invention.
Figure 5:
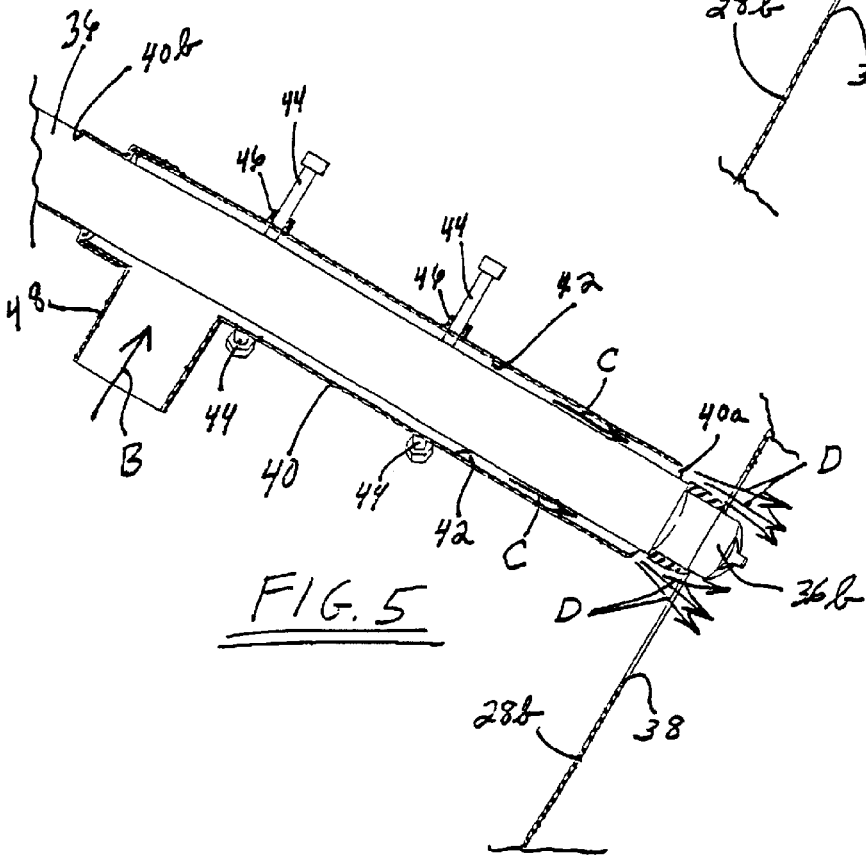
FIG. 5 is a section taken generally along line 5—5 of FIG. 4.

FIGS. 4 and 5 show one of the spray guns 36 with the respective nozzle 36*b* thereof projecting through one of the openings 38 in one of the angled top walls 28*b* of cover 28. At this point, it should be understood that the spray guns are not shown in considerable detail herein, because the spray guns can be of a variety of types and/or configurations within the concepts of the invention. For instance, the spray guns may be of a type for spraying a UV curable coating composition as discussed in the "Background", above. The spray guns may have nozzles which atomize the spray material within the spray chamber provided by housing 14.

Generally, the invention contemplates the provision of means for facilitating maintaining consistent temperatures for spray guns 36 and, thereby, controlling the temperature of the coating composition or material passing through the spray guns. Specifically, and still referring to FIGS. 4 and 5 in conjunction with FIGS. 1–3, a shroud 40 in the form of a tubular member is disposed about each spray gun 36 to define an air passage 42 (FIG. 5) between an inside of the shroud and the outside of the spray gun. As shown in FIGS. 4 and 5, the spray guns are elongated and generally cylindrical and, consequently, tubular shrouds 40 also are cylindrical. However, other configurations are contemplated by the invention in order to provide an air passage about the outside of each spray gun. Each shroud 40 is secured to its respective spray gun by a plurality of set screws 44 spaced longitudinally and circumferentially about the shroud. The set screws are threaded through nuts 46 fixed to the outside surface of the shroud. For instance, the shroud can be fabricated of metal material, and the nuts can be adhered thereto, as by welding. The set screws can adjust the spacing (i.e., passages 42) between the shrouds and the spray guns.

Referring particularly to FIG. 5, each shroud 40 includes an open end 40*a* near nozzle 36*b* of the respective spray gun, along with a closed remote end 40*b*. A hollow nipple 48 projects outwardly from one side of the shroud in communication with air passage 42 between the shroud and the spray gun. The nipple is located near closed end 40*b* of the shroud. Therefore, it can be understood that if heated air is fed to nipple 48 in the direction of arrow "B", the air will enter air passage 42 and travel from the closed end of the shroud in the direction of arrows "C", out of open end 40*a* of the shroud in the direction of arrows "D" around the outer periphery of nozzle 36*b*. Set screws 40 can be adjusted so that air passage 42 has generally uniform dimensions about the periphery of the spray gun for consistency purposes. By passing heated air around the outside of each spray gun 36, the spray composition or material passing through the spray gun also is heated, thereby controlling the temperature of the sprayed material.

FIG. 5 also shows a unique side-advantage of the arrangement of the invention. Specifically, arrows "D" show that the heated air which exits open end 40*a* of shroud 40 is directed around nozzle 36*b*. This flow of air is effective to continuously remove any accumulation of the spray composition on the nozzle. As stated in the "Background", above, droplets tend to accumulate on the ends of spray nozzles, and, if these droplets fall on the articles to be sprayed, blemishes are formed. This flow of air as represented by arrows "D" prevents the formation of droplets while performing the dual function of heating the spray material flowing through the spray guns, as described above.

Referring back to FIGS. 1–3, it can be seen that nipples 48 of shrouds 40 are connected by conduits 50 to an enlarged manifold 52 having an open end 52*a* and a closed end 52*b*. As will be seen hereinafter, a source of heated air can be fed to open end 50*a* of the manifold in the direction of arrows "E", whereby the heated air can be fed from the enlarged manifold 52 to all of the plurality of shrouds 40, through conduits 50 and nipples 48 of the shrouds. Manifold 52 is fixed to the top of cover 28, as by welding, and conduits 50 are rigid enough to support and mount spray guns 36.

Figure 6:
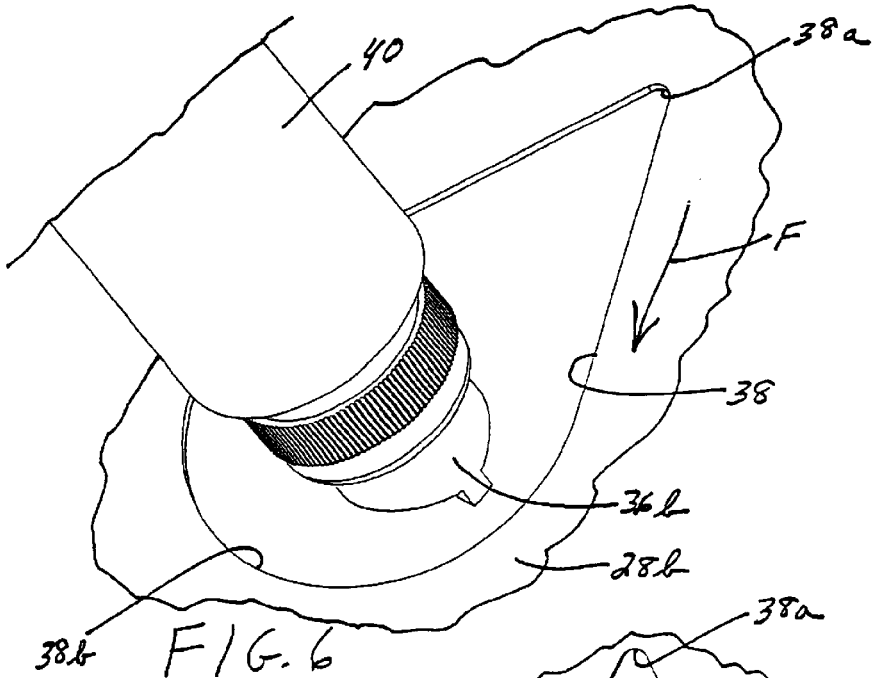
FIG. 6 is a further enlarged perspective view of the nozzle end of one of the spray guns extending through one of the openings in the top wall of the apparatus housing.
Figure 7:
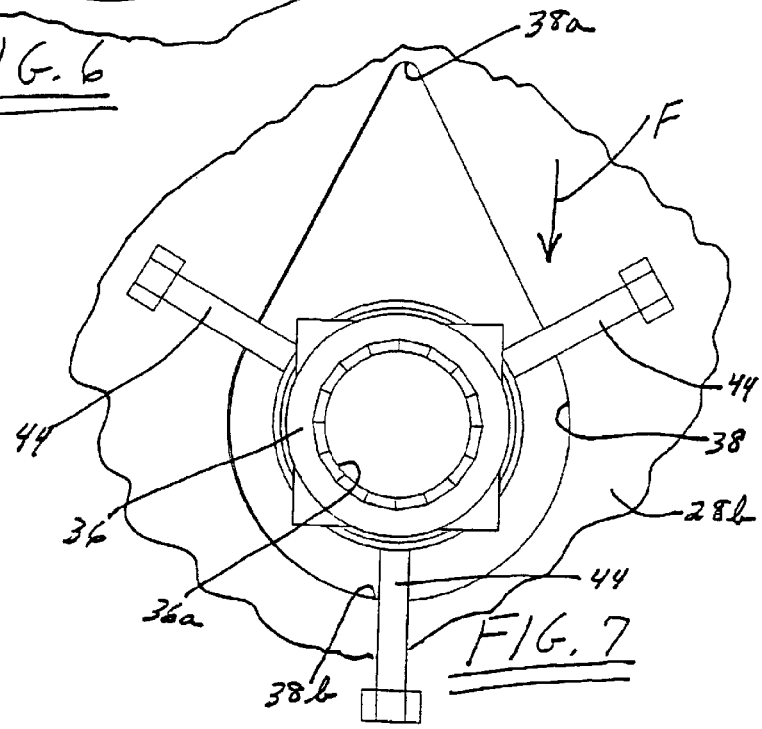
FIG. 7 is a plan view similar to that of FIG. 6.

As stated above, top walls 28*a* of cover 28 are angled downwardly at approximately 25°–30° to allow spray composition to flow down the insides of the walls in the spray chamber. FIGS. 6 and 7 show one of the nozzles 36*b* of one of the spray guns 36 projecting into one of the openings 38 in one of the top walls 28*b* of the cover. Arrows "F" represent the downward sloping direction of the top wall. The invention contemplates that each opening 38 be void of any sharp corners, at least except for a top relatively narrow upper edge 30*a* of the opening. If the opening was orthogonal, for instance, sharp corners would be created whereat the spray composition would accumulate and create potentially damaging droplets. The invention contemplates that the peripheral edge of opening 38 be arcuate or rounded to eliminate any sharp corners. In the preferred embodiment, opening 38 has a "teardrop" shape to define a relatively wide, arcuate bottom edge 38*b* opposite the relatively narrow arcuate upper edge 38*a*.

Figure 8:
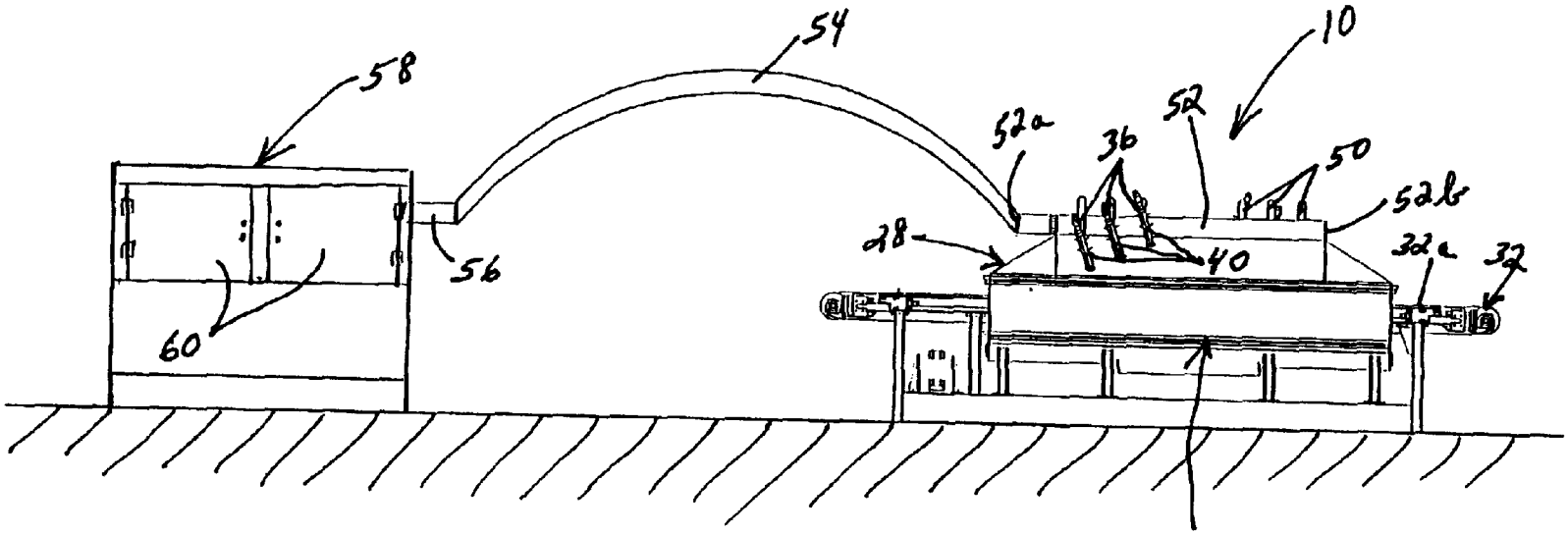
FIG. 8 is a somewhat schematic illustration of a system according to the invention and incorporating the apparatus of FIGS. 1–3.

FIG. 8 shows a system of the invention wherein a ready-made source of heated air in an overall finishing process can be used for supplying heated air to shrouds 40 about spray guns 36. Specifically, apparatus 10 is shown in FIG. 8, with open end 52*a* of manifold 50 connected by a conduit 54 to an exhaust 56 from a curing apparatus, generated designated 58. The curing apparatus is shown somewhat schematically in FIG. 8, simply to include a pair of doors 60 through which articles sprayed at coating apparatus 10 can be placed into the curing apparatus in order to cure the coating sprayed onto the articles at the coating apparatus. For instance, curing apparatus 58 could be a UV curing apparatus whereat the curable coating composition applied by coating apparatus 10 is subjected to ultraviolet light. The UV light is provided by UV lamps which produce heat. This heat is exhausted at exhaust 56 in order to keep the UV lamps cooled. The heated air from exhaust 56 often is simply vented to atmosphere and wasted. The system of the invention utilizes this ready source of heated air in the overall finishing process as the source of heated air fed to shrouds 40. Therefore, a separate force of heated air is not required at coating apparatus 10. Preferably, conduit 50 is insulated to prevent heat loss of the heated air in transit to coating apparatus 10.

Of course, the invention is not limited to a UV curing apparatus, because apparatus 58 could be a variety of curing mechanisms or stations. Various types of spray coating compositions require heat for curing or drying or, at least, the apparatus, itself, may generate a source of heated air which can be used to feed shrouds 40 rather than wasting the source of heated air to atmosphere.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An apparatus for spray coating an article, comprising:

a housing defining a spray chamber and including a downwardly sloping top wall having an opening:

a spray gun extending through the opening in the top wall of the housing for spray coating an article in the spray chamber; and said opening being generally teardrop-shaped to define a relatively narrow upper edge and a relatively wide lower edge to prevent droplets from forming along the edges of the opening.

2. The apparatus of claim 1 wherein the lower edge of said teardrop-shaped opening is arcuate in shape.

3. The apparatus of claim 2 wherein substantially the entire peripheral edge of said opening is rounded and void of any sharp corners at least except for said relatively narrow upper edge of the opening.

4. An apparatus for spray coating an article, comprising:

a housing defining a spray chamber and including a downwardly sloping top wall having an opening;

a spray gun extending through the opening in the top wall of the housing for spray coating an article in the spray chamber; and said opening being generally shaped to define a relatively narrow upper edge and a relatively wide lower edge to prevent droplets from forming along the edges of the opening, wherein substantially the entire lower edge of said opening is rounded and void of any sharp corners at least except for said relatively narrow upper edge of the opening.

5. The apparatus of claim 4 wherein the lower edge of said shaped opening is arcuate in shape.

* * * * *